US010354637B1

(12) United States Patent
Lin

(10) Patent No.: US 10,354,637 B1
(45) Date of Patent: Jul. 16, 2019

(54) SOUND RECEIVING DEVICE AND NOISE SIGNAL GENERATING METHOD THEREOF

(71) Applicant: CHICONY ELECTRONICS CO., LTD., New Taipei (TW)

(72) Inventor: Wen-Chang Lin, New Taipei (TW)

(73) Assignee: Chicony Electronics Co., Ltd., New Taipei (TW)

( * ) Notice: Subject to any disclaimer, the term of this patent is extended or adjusted under 35 U.S.C. 154(b) by 0 days.

(21) Appl. No.: 16/234,189

(22) Filed: Dec. 27, 2018

(30) Foreign Application Priority Data

Jun. 26, 2018 (TW) ..... 107121952 A

(51) Int. Cl.
*G10K 11/175* (2006.01)
*H04R 29/00* (2006.01)
*H04R 3/00* (2006.01)

(52) U.S. Cl.
CPC ..... *G10K 11/175* (2013.01); *H04R 3/00* (2013.01); *H04R 29/00* (2013.01)

(58) Field of Classification Search
CPC ..... H04R 29/00; H04R 3/00; G10K 11/175
USPC ..... 381/56
See application file for complete search history.

(56) References Cited

U.S. PATENT DOCUMENTS 4,914,706 A * 4/1990 Krause ..... G01R 33/283 381/73.1

* cited by examiner

*Primary Examiner* — Paul Kim
(74) *Attorney, Agent, or Firm* — Muncy, Geissler, Olds & Lowe, P.C.

(57) ABSTRACT

A sound receiving device and a noise signal generating method thereof are disclosed. A linear voltage regulator module of the sound receiving device receives a power signal for converting into a first current signal. A microphone is used to receive an external audio signal. A digital modulation module receives the first current signal so as to process the external audio signal to become a digital audio signal. After the linear voltage regulator module receives a control signal, the first current signal is stopped, and the power signal is transmitted through a current limiting resistor to generate a second current signal to the digital modulation module, so that the digital modulation module generates and output a noise signal, wherein an amperage of the second current signal is less than an amperage of the first current signal and is not enough to normally drive the digital modulation module.

6 Claims, 3 Drawing Sheets

SOUND RECEIVING DEVICE AND NOISE SIGNAL GENERATING METHOD THEREOF

BACKGROUND OF THE INVENTION

1. Field of the Invention

The present invention relates to a sound receiving device and a noise signal generating method thereof; more particularly, the present invention relates to a sound receiving device and a noise signal generating method thereof capable of generating noises by means of differences of received current signals.

2. Description of the Related Art

With the advance of technology, electronic devices, such as smart phones, tablet computers, laptop computers or even desktop hosts, equipped with cameras or microphones are common in modern life. However, privacy requests come along with such advance. Take microphone privacy problems as an example, in known prior arts, such problems can be solved by means of hardware or software. Hardware-wise, it is required to add a switch unit for a multiplexer or add an extra sound module in order to replace an output signal of a microphone by another sound source. Software-wise, it is prone to be attacked by hackers. Further, if the volume of an input source of the microphone is directly turned down to minimum level or mute, it would easily cause its user to be confused with current usage state.

Therefore, there is a need to provide a novel sound receiving device and a noise signal generating method thereof to mitigate and/or obviate the aforementioned problems.

SUMMARY OF THE INVENTION

It is an object of the present invention to provide a sound receiving device capable of generating noises by means of differences of received current signals.

It is another object of the present invention to provide a noise signal generating method used in the abovementioned sound receiving device.

To achieve the abovementioned objects, the sound receiving device of the present invention comprises a power supply end, a linear voltage regulator module, a microphone, a digital modulation module and a current limiting resistor. The power supply end is used for supplying a power signal. The linear voltage regulator module is electrically connected to the power supply end, and is used for receiving the power signal for converting into a first current signal. The microphone is used for receiving an external audio signal. The digital modulation module is electrically connected to the microphone and the linear voltage regulator module, and is used for receiving the first current signal so as to process the external audio signal to become a digital audio signal. The current limiting resistor is electrically connected to the power supply end and connected in parallel to the linear voltage regulator module, wherein after the linear voltage regulator module receives a control signal, the first current signal is stopped, and the power signal of the power supply end is transmitted through the current limiting resistor to generate a second current signal to the digital modulation module, so that the digital modulation module generates and outputs a noise signal, where an amperage of the second current signal is less than an amperage of the first current signal and is not enough to normally drive the digital modulation module.

The noise signal generating method of the present invention comprises the following steps: receiving, via a microphone, an external audio signal; receiving, via a linear voltage regulator module, a power signal for converting into a first current signal; driving a digital modulation module according to the first current signal, so as to process the external audio signal to become a digital audio signal; and after the linear voltage regulator module receives a control signal, performing the following steps: stopping the first current signal; transmitting the power signal through a current limiting resistor to generate a second current signal to the digital modulation module, wherein an amperage of the second current signal is less than an amperage of the first current signal and is not enough to normally drive the digital modulation module; and generating and outputting a noise signal.

Other objects, advantages, and novel features of the invention will become more apparent from the following detailed description when taken in conjunction with the accompanying drawings.

BRIEF DESCRIPTION OF THE DRAWINGS

These and other objects and advantages of the present invention will become apparent from the following description of the accompanying drawings, which disclose several embodiments of the present invention. It is to be understood that the drawings are to be used for purposes of illustration only, and not as a definition of the invention.

In the drawings, wherein similar reference numerals denote similar elements throughout the several views.

DETAILED DESCRIPTION OF THE PREFERRED EMBODIMENT

Figure 1:
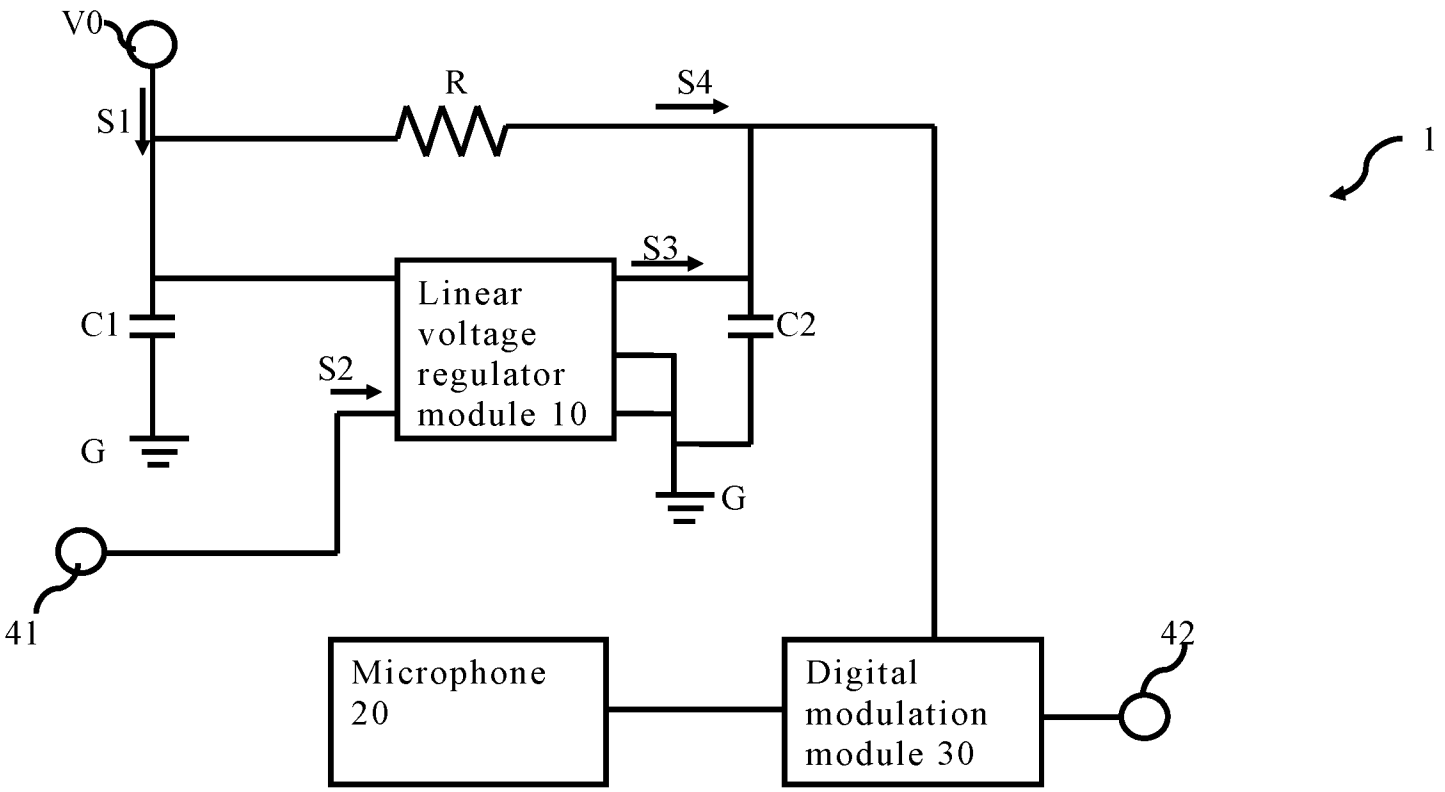
FIG. 1 illustrates a structural schematic drawing of a sound receiving device according to the present invention.

Please refer to FIG. 1, which illustrates a structural schematic drawing of a sound receiving device according to the present invention.

In one embodiment of the present invention, the sound receiving device 1 can be, without limiting the scope of the present invention, a smart phone, a tablet computer, a laptop computer or a desktop host, or partial assemblies of the abovementioned devices. The sound receiving device 1 comprises a power supply end V0, a linear voltage regulator module 10, a microphone 20, a digital modulation module 30 and a current limiting resistor R. Further, the sound receiving device 1 can also comprise capacitors C1, C2 and a grounding terminal G Because functions of the capacitors C1, C2 and the grounding terminal G are not key point to the present invention, there is no need for further description. Moreover, please note that the structural schematic drawing as shown in FIG. 1 is just for illustration purpose, while the scope of the sound receiving device 1 of the present invention is not limited to comprising only the components shown in FIG. 1.

The power supply end V0 is used for supplying a power signal S1. The linear voltage regulator module 10 is electrically connected to the power supply end V0, and is used for receiving the power signal S1 for converting into a first current signal S3, wherein the first current signal S3 is a current capable of normally driving the digital modulation module 30. The linear voltage regulator module 10 is further connected to a control signal input end 41. The control signal input end 41 allows a user to operate for determining whether to transmit a control signal S2 to the linear voltage regulator module 10. The microphone 20 is used for receiving an external audio signal. The digital modulation module 30 is electrically connected to the microphone 20 and the linear voltage regulator module 10, and is used for receiving the first current signal S3. When the digital modulation module 30 receives enough current from the first current signal S3, it can then process the external audio signal to become a digital audio signal D (as shown in FIG. 2) for being outputted via an audio signal output end 42.

The current limiting resistor R is electrically connected to the power supply end V0, and is connected in parallel to the linear voltage regulator module 10. After the linear voltage regulator module 10 receives the control signal S2, the linear voltage regulator module 10 stops providing the first current signal S3, and the power signal S1 of the power supply end V0 is transmitted through the current limiting resistor R to generate a second current signal S4. Accordingly, the digital modulation module 30 only receives the second current signal S4. Because an amperage of the second current signal S4 is less than an amperage of the first current signal S3, it is not enough to normally drive the digital modulation module 30. For example, when the digital modulation module 30 operates normally, it modulates a working current of the external audio signal, which is the first current signal S3, to 600 uA; when the digital modulation module 30 operates abnormally, it modulates a working current of a noise signal, which is the second current signal S4, to 200 uA. As a result, the amperage of the second current signal S4 is less than or equal to one-third of the amperage of the first current signal S3. However, please note the amperage value is not limited to the abovementioned description. Therefore, the digital modulation module 30 cannot obtain enough current to drive, and thus the processed external audio signal would become a noise signal N (as shown in FIG. 2) for being outputted to the audio output end 42. After the linear voltage regulator module 10 receives another control signal S2 once again, the supply of the first current signal S3 to the digital modulation module 30 is resumed, therefore the digital modulation module 30 can re-generate the normal digital audio signal D.

Figure 2:
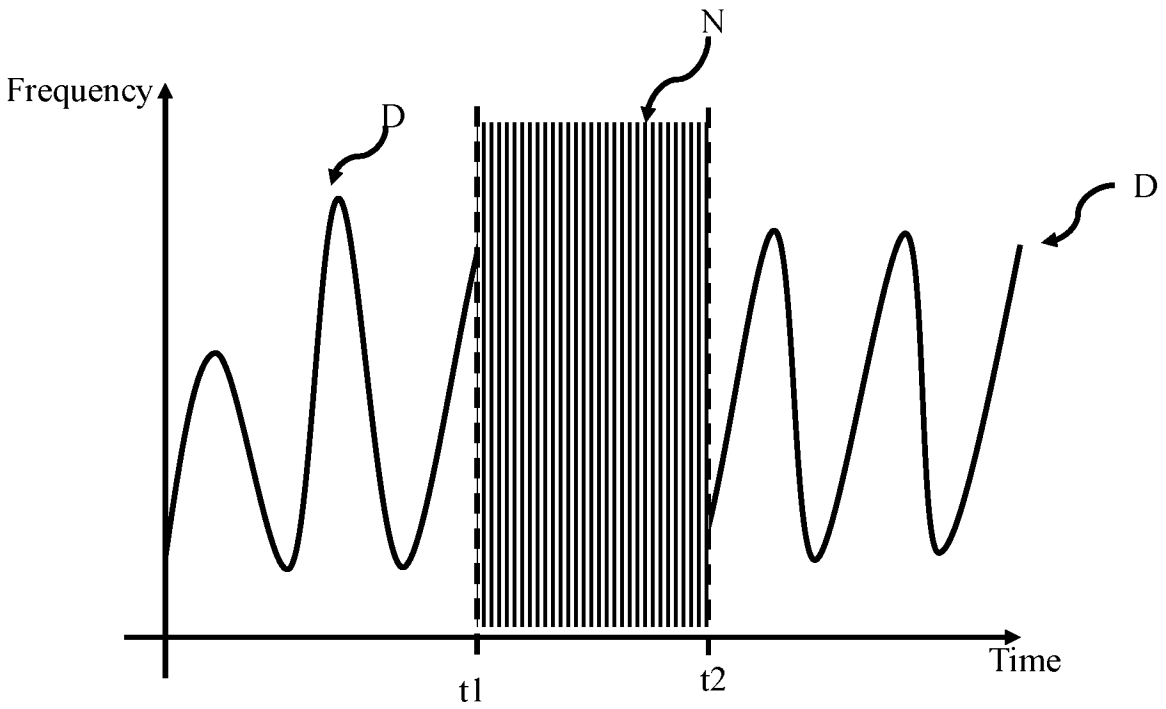
FIG. 2 illustrates a schematic drawing of related waveforms of digital audio signals and noise signals according to the present invention.

Please refer to FIG. 2, which illustrates a schematic drawing of related waveforms of digital audio signals and noise signals according to the present invention. When the digital modulation module 30 receives enough amperage from the first current signal S3, the digital modulation module 30 can normally output the digital audio signal D. At Time t1, the linear voltage regulator module 10 receives the control signal S2, and thus the first current signal S3 is stopped. At this time the digital modulation module 30 only receives insufficient amperage from the second current signal S4, and therefore the digital modulation module 30 would output the noise signal N. At Time t2, the linear voltage regulator module 10 receives another control signal S2 once again, and thus the supply of the first current signal S3 is resumed. At this time, the digital modulation module 30 would be driven normally for the reason of receiving enough amperage from the first current signal S3, in order to output the digital audio signal D. Please note that in this embodiment, the noise signal N cannot be restored to the original digital audio signal D.

Please note that each module of the sound receiving device 1 can be accomplished by a hardware device, a software program combined with a hardware device, firmware combined with a hardware device or combination thereof without limiting the scope of the present invention.

Further, embodiments disclosed herein are only preferred embodiments as examples for describing the present invention, in order to avoid redundant expressions, not all possible variations and combinations are described in details in this specification. However, those skilled in the art would understand the above modules or components are not all necessary parts. Or, in order to implement the present invention, other more detailed known modules or components might also be included. It is possible that each module or component can be omitted or modified depending on different requirements; and it is also possible that other modules or components might be disposed between any two modules.

Figure 3:
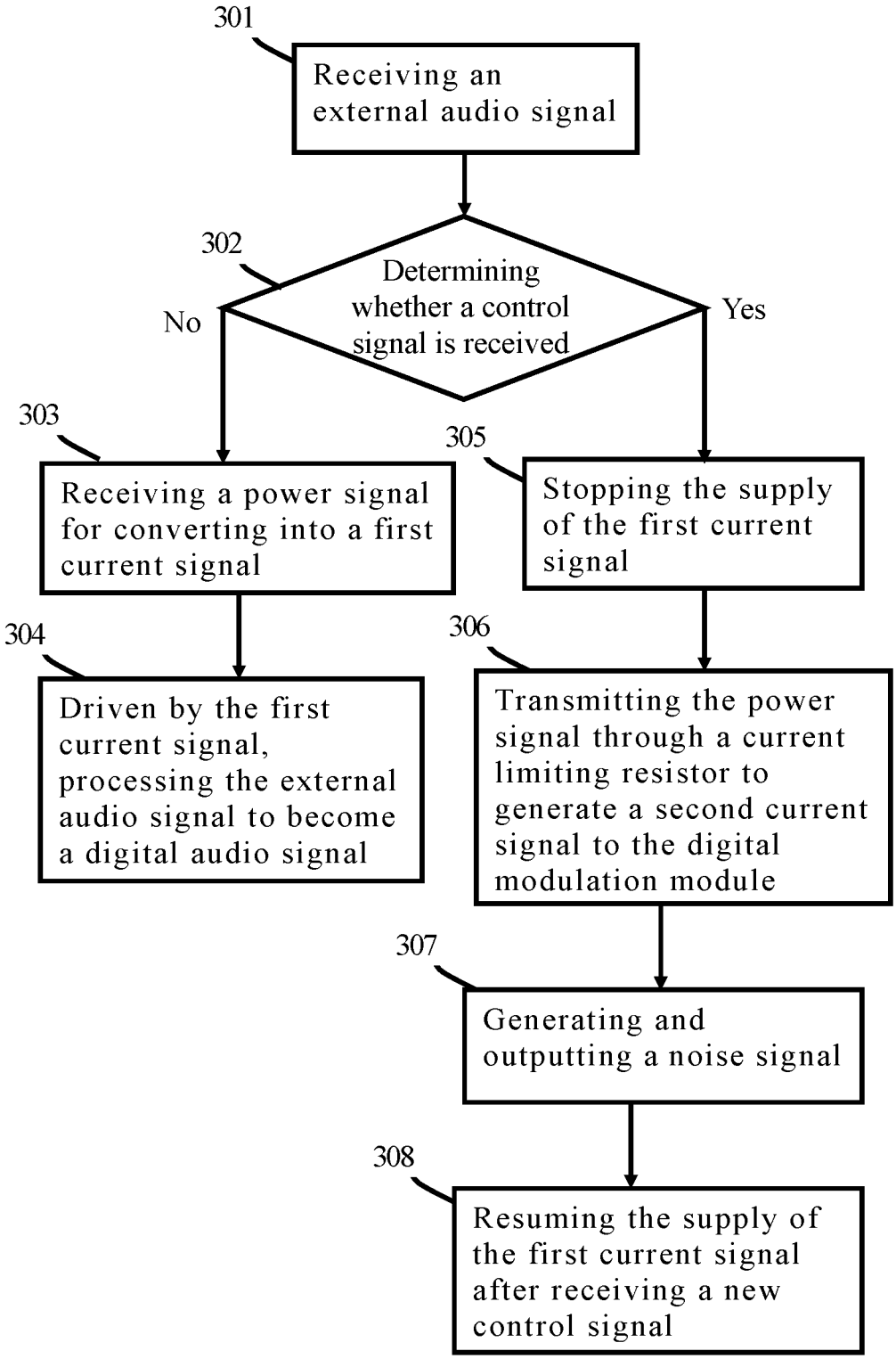
FIG. 3 illustrates a flowchart of a noise signal generating method according to the present invention.

Next, please refer to FIG. 3, which illustrates a flowchart of a noise signal generating method according to the present invention. Please note that the abovementioned sound receiving device 1 is simply used as an example for explaining the noise signal generating method according to the present invention, the noise signal generating method of the present invention is not limited to be used in the sound receiving device 1 having exactly the same structure.

First, the method performs step 301: receiving an external audio signal.

At first, the microphone 20 is used for receiving an external audio signal.

Then, the method performs step 302: determining whether a control signal is received.

Then, the linear voltage regulator module 10 determines whether a control signal S2 is received from the control signal input end 41.

If the linear voltage regulator module 10 does not receive the control signal S2, the method performs step 303: receiving a power signal for converting into a first current signal.

At this time, the linear voltage regulator module 10 would receive the power signal S1 from the power supply end V0 for converting into the first current signal S3.

Next, the method performs step 304: driven by the first current signal, processing the external audio signal to become a digital audio signal.

Next, after the digital modulation module 30 receives enough current from the first current signal S3, it can then process the external audio signal to become a digital audio signal D.

Further, if the linear voltage regulator module 10 receives the control signal S2, the method performs step 305: stopping the supply of the first current signal.

At this time, after the linear voltage regulator module 10 receives the control signal S2 from the control signal input end 41, the linear voltage regulator module 10 stops supplying the first current signal S3.

Then, the method performs step 306: transmitting the power signal through a current limiting resistor to generate a second current signal to the digital modulation module.

The power signal S1 of the power supply end V0 would be transmitted through the current limiting resistor R so as to generate the second current signal S4, wherein the amperage of the second current signal S4 is less than the amperage of the first current signal S3. Accordingly, the digital modulation module 30 only receives the second current signal S4.

Next, the method performs step 307: generating and outputting a noise signal.

Because the digital modulation module 30 could not obtain enough driven current, it can only convert the external audio signal into a noise signal N.

Finally, the method performs step 308: resuming the supply of the first current signal after receiving a new control signal.

Finally, after the linear voltage regulator module 10 receives a new control signal S2 once again, the supply of the first current signal S3 is resumed. Accordingly, the digital modulation module 30 could normally output the digital audio signal D for the reason of receiving enough amperage from the first current signal S3.

Please note that the noise signal generating method of the present invention is not limited to the above step orders. The execution order of the abovementioned steps can be altered as long as the object of the present invention can be achieved.

As a result, the sound receiving device 1 of the present invention can easily generate the noise signal N without the need of installing an extra hardware switch. Further, the noise signal N cannot be restored to the original digital audio signal D, so as to achieve the requirement of protecting information privacy.

Although the invention has been described with reference to the above embodiments, it will be apparent to one of the ordinary skill in the art that modifications to the described embodiments may be made without departing from the spirit of the invention. Accordingly, the scope of the invention will be defined by the attached claims rather than by the above detailed descriptions.

What is claimed is:

1. A sound receiving device, comprising:

a power supply end, used for supplying a power signal;

a linear voltage regulator module, electrically connected to the power supply end, used for receiving the power signal for converting into a first current signal;

a microphone, used for receiving an external audio signal;

a digital modulation module, electrically connected to the microphone and the linear voltage regulator module, used for receiving the first current signal so as to process the external audio signal to become a digital audio signal; and a current limiting resistor, electrically connected to the power supply end and connected in parallel to the linear voltage regulator module, wherein after the linear voltage regulator module receives a control signal, the first current signal is stopped, and the power signal of the power supply end is transmitted through the current limiting resistor to generate a second current signal to the digital modulation module, so that the digital modulation module generates and outputs a noise signal, wherein an amperage of the second current signal is less than an amperage of the first current signal and is not enough to normally drive the digital modulation module.

2. The sound receiving device as claimed in claim 1, wherein after the linear voltage regulator module receives a new control signal, the supply of the first current signal to the digital modulation module is resumed.

3. The sound receiving device as claimed in claim 1, wherein the amperage of the second current signal is less than or equal to one-third of the amperage of the first current signal.

4. A noise signal generating method, used in a sound receiving device, the method comprising:

receiving, via a microphone, an external audio signal;

receiving, via a linear voltage regulator module, a power signal for converting into a first current signal;

driving a digital modulation module according to the first current signal, so as to process the external audio signal to become a digital audio signal; and after the linear voltage regulator module receives a control signal, performing the following steps:

stopping the first current signal;

transmitting the power signal through a current limiting resistor to generate a second current signal to the digital modulation module, wherein an amperage of the second current signal is less than an amperage of the first current signal and is not enough to normally drive the digital modulation module; and generating and outputting a noise signal.

5. The noise signal generating method as claimed in claim 4, further comprising the following steps:

after the linear voltage regulator module receives a new control signal, resuming the supply of the first current signal to the digital modulation module.

6. The noise signal generating method as claimed in claim 4, wherein the amperage of the second current signal is less than or equal to one-third of the amperage of the first current signal.

* * * * *